US010702737B2

(12) United States Patent
Zhou

(10) Patent No.: US 10,702,737 B2
(45) Date of Patent: Jul. 7, 2020

(54) EXERCISE MACHINE WITH BOATING AND RIDING EXERCISE EFFECTS

(71) Applicant: Xiamen Zhoulong Sporting Goods Co., Ltd., Xiamen, Fujian (CN)

(72) Inventor: Yuzhi Zhou, Xiamen (CN)

(73) Assignee: XIAMEN ZHOULONG SPORTING GOODS CO., LTD., Xiamen (CN)

( * ) Notice: Subject to any disclaimer, the term of this patent is extended or adjusted under 35 U.S.C. 154(b) by 99 days.

(21) Appl. No.: 16/042,165

(22) Filed: Jul. 23, 2018

(65) Prior Publication Data

US 2019/0022454 A1 Jan. 24, 2019

(30) Foreign Application Priority Data

Jul. 24, 2017 (CN) ..... 2017 2 0899398 U

(51) Int. Cl.

| | |
|---|---|
| ***A63B 22/00*** | (2006.01) |
| ***A63B 21/00*** | (2006.01) |
| ***A63B 21/04*** | (2006.01) |
| ***A63B 21/055*** | (2006.01) |
| ***A63B 22/20*** | (2006.01) |

(Continued)

(52) U.S. Cl.

CPC .... *A63B 22/0076* (2013.01); *A63B 21/00072* (2013.01); *A63B 21/0421* (2013.01); *A63B 21/0428* (2013.01); *A63B 21/0552* (2013.01); *A63B 21/068* (2013.01); *A63B 21/4031* (2015.10); *A63B 21/4034* (2015.10); *A63B 22/0005* (2015.10); *A63B 22/203* (2013.01); *A63B 22/0089* (2013.01); *A63B 22/205* (2013.01); *A63B 71/0036* (2013.01); *A63B 2022/0033* (2013.01); *A63B 2022/0041* (2013.01); *A63B 2022/0079* (2013.01); *A63B 2022/0082* (2013.01); *A63B 2210/50* (2013.01); *A63B 2225/093* (2013.01)

(58) Field of Classification Search

CPC .... A63B 2022/0082; A63B 2022/0084; A63B 22/0087; A63B 22/0089; A63B 22/0076; A63B 22/20–208

See application file for complete search history.

(56) References Cited

U.S. PATENT DOCUMENTS 4,300,760 A * 11/1981 Bobroff ..... A63B 21/068 482/96

4,541,627 A * 9/1985 MacLean ..... A63B 22/0076 482/112

(Continued)

*Primary Examiner* — Nyca T Nguyen

(74) *Attorney, Agent, or Firm* — Muncy, Geissler, Olds & Lowe, P.C.

(57) ABSTRACT

Exercise machine includes a base and a cushion. The cushion is slidably connected to the rotary rod. A left pedal and a right pedal are arranged at the front end of the base or at positions. A supporting rail is arranged on the base and has two sides respectively provided with guide grooves. A sliding frame is cooperatively disposed on the supporting rail and provided with left wheels and right wheels, which are respectively matched with the guide grooves. A left cross rod and a right cross rod respectively extend out from two sides of the supporting rod. A left pull rod and a right pull rod are respectively hinged to the end of the left cross rod and the end of the right cross rod. Elastic ropes are disposed between the left pull rod and the rotary rod, and also between the right pull rod and the rotary rod.

10 Claims, 5 Drawing Sheets

(51) Int. Cl.
*A63B 21/068* (2006.01)
*A63B 71/00* (2006.01)

(56) References Cited

U.S. PATENT DOCUMENTS 5,299,997 A * 4/1994 Chen ..... A63B 21/068 482/72
5,429,568 A * 7/1995 Chen ..... A63B 21/068 482/57
5,470,295 A * 11/1995 Wang ..... A63B 21/068 482/71
5,512,027 A * 4/1996 Chen ..... A63B 22/0076 482/130
5,580,340 A * 12/1996 Yu ..... A63B 21/055 482/72
5,582,563 A * 12/1996 Fan ..... A63B 22/0076 482/72
5,649,885 A * 7/1997 Liljenquist ..... A63B 21/068 482/57
6,001,051 A * 12/1999 Chuan-Pin ..... A63B 21/0552 482/131
6,093,135 A * 7/2000 Huang ..... A63B 21/068 482/112
6,264,588 B1 * 7/2001 Ellis ..... A63B 21/068 482/100
6,287,241 B1 * 9/2001 Ellis ..... A63B 21/06 482/100
7,052,444 B2 * 5/2006 Webber ..... A63B 21/068 482/100
D622,788 S * 8/2010 Khubani ..... A63B 21/00069 D21/674
7,766,802 B2 * 8/2010 Webber ..... A63B 21/159 482/100
7,828,700 B1 * 11/2010 Tsai ..... A63B 23/1209 482/121
2005/0148444 A1 * 7/2005 Thomas ..... A63B 21/151 482/72
2005/0164848 A1 * 7/2005 Carbone ..... A63B 22/0076 482/92
2006/0172867 A1 * 8/2006 Lee ..... A63B 22/0012 482/57
2010/0093497 A1 * 4/2010 Kuo ..... A63B 21/154 482/52
2014/0243163 A1 * 8/2014 Edmondson ..... A63B 22/0076 482/72
2015/0360068 A1 * 12/2015 Lagree ..... A63B 21/00069 482/142
2016/0279464 A1 * 9/2016 Liu ..... A63B 22/0076

* cited by examiner

EXERCISE MACHINE WITH BOATING AND RIDING EXERCISE EFFECTS

BACKGROUND OF THE INVENTION

Technical Field

The invention relates to the technical field of manufacturing of exercise machines, in particular to an exercise machine with boating and riding exercise effects.

Description of Related Art

The improvement of living standards has led to wide application of exercise machines by people. Nowadays, various types of exercise machines, among which riding machines and boating machines are included, have already appeared on the market. However, the riding machines can only simulate riding postures, the boating exercise machines can only simulate boating postures, and due to the single motion state of the riding machines or the boating machines, the exercise pleasure and exercise effect are limited. On account of this, the applicant put forwards, on Aug. 6, 2015, Chinese Invention Patent with Application No ZL201520216931.5 and titled Exercise Machine with Boating and Riding Exercise Effects, which has both the boating exercise effect and the riding exercise effect, thus, improving the exercise effect and exercise pleasure. However, the working stability and comfort of this exercise machine have yet to be improved, and thus, the following patent is put forward.

BRIEF SUMMARY OF THE INVENTION

The technical issue to be settled by the invention is to provide an exercise machine, which has both a boating exercise effect and a riding exercise effect and also has higher reliability, comfort and safety in use.

To fulfill the above objective, the invention adopts the following technical scheme. An exercise machine with boating and riding exercise effects includes a base and a cushion. The front end of a rotary rod is hinged to the front end of the base. The cushion is slidably connected to the rotary rod. A left pedal and a right pedal are arranged at the front end of the base or at positions, close to the front end of the base, of the rotary rod. A supporting rail is arranged on the base. Guide grooves are respectively formed in two sides of the supporting rail. A sliding frame is cooperatively disposed on the supporting rail and provided with left wheels and right wheels. The left wheels and the right wheels are respectively matched with the guide grooves in the two sides of the supporting rail.

One end of a supporting rod is hinged to the lower side of the middle of the rotary rod, and the other end of the supporting rod is hinged to the sliding frame. A left cross rod and a right cross rod respectively extend out from two sides of the middle of the supporting rod. A left pull rod and a right pull rod are respectively hinged to the end of the left cross rod and the end of the right cross rod.

Furthermore, elastic ropes are disposed between the left pull rod and the rotary rod as well as between the right pull rod and the rotary rod.

Furthermore, a first suspension pin is arranged on the lower portion of the rotary rod, second suspension pins are arranged in the middle of the left pull rod and the middle of the right pull rod, the elastic ropes are suspended between the second suspension pins and the first suspension pin. In this way, the elastic ropes can be assembled conveniently. Hooking wheels are disposed on the second suspension pins, and one ends of the elastic ropes are wound on the hooking wheels. In this way, the service life of the elastic ropes is prolonged.

Furthermore, a left limiting part is fixedly arranged on the outer surface of an end, close to the left cross rod, of the left pull rod, and when touching the left cross rod, the left limiting part restrains the left pull rod from continuing to rotate towards the rotary rod. A right limiting part is fixedly arranged on the outer surface of an end, close to the right cross rod, of the right pull rod, and when touching the right cross rod, the right limiting part restrains the right pull rod from continuing to rotate towards the rotary rod. In this way, the left pull rod and the right pull rod are prevented from deflecting towards one side during exercise.

Preferably, the sliding frame includes a first n-shaped frame. Two left wheels are arranged on the left inner side of the first n-shaped frame. Two right wheels are arranged on the right inner side of the first n-shaped frame. The two left wheels and the two right wheels are respectively matched with the guide grooves in the two sides of the supporting rail. Two protrusions respectively extend out from two sides of the upper portion of the first n-shaped frame and hinged to the other end of the supporting rod through a hinge pin. In this way, the stability during exercise is further improved.

Preferably, the cushion includes a cushion plate and a second n-shaped frame fixedly connected to the lower side of the cushion plate. Two cushion wheels are disposed on each of two inner side faces of the second n-shaped frame. A cushion guide groove is formed in each of two side faces of the rotary rod. Each cushion guide groove is matched with the two corresponding cushion wheels.

Preferably, a third n-shaped frame is fixedly arranged on the middle lower portion of the rotary rod and hinged to one end of the supporting rod. A first limiting post is disposed on the third n-shaped frame and used to limit the clockwise rotation angle of the supporting rod.

Furthermore, a second limiting post is arranged on the rear lower portion of the rotary rod and matched with the supporting rod to limit the descent height of the free end of the rotary rod.

Furthermore, a protruding frame extends upwards from the middle of the front end of the base. A left horizontal dowel pin is arranged on the left side of the protruding frame. The left pedal is rotatably disposed around the left horizontal dowel pin. A right horizontal dowel pin is arranged on the right side of the protruding frame. The right pedal is rotatably disposed around the right horizontal dowel pin. One end of the rotary rod is hinged to the protruding frame. A counter is arranged on the upper side of the front end of the rotary rod.

Preferably, the supporting rod includes a front supporting rod section and a rear supporting rod section. The front supporting rod section is sleeved with the rear supporting rod section, which is provided with a plurality of positioning holes at intervals. An adjusting bolt penetrates through the side face of the front supporting rod section to be selectively matched with one positioning hole on the rear supporting rod section. In this way, the length of the supporting rod and the pulling force to the left pull rod and the right pull rod can be changed to adjust the exercise intensity.

According to the exercise machine of the invention, the user sits on the cushion to make boating motions by stepping on the left pedal and the right pedal with both feet and by holding the left pull rod and the right pull rod with both hands. Under the combined effect of a pulling force and the weight of the user, the supporting rod and the rotary rod rotate back and forth, so that the human body also moves upwards, downwards, forwards and backwards while making boating motions, and thus, both a boating exercise effect and a riding exercise effect are achieved, and the exercise pleasure and the exercise effect are effectively improved.

Moreover, the guide grooves are respectively formed in the two sides of the supporting rail, the sliding frame is cooperatively disposed on the sliding rail and provided with the left wheels and the right wheels, the left wheels and the right wheels are respectively matched with the guide grooves in the two sides of the supporting rail, in this way, when people move upwards and downwards, the supporting rod will not be separated from the base, and thus, people are protected against suspension and impact, and the reliability and comfort in use are improved. In addition, the elastic ropes are disposed between the left pull rod and the rotary rod as well as between the right pull rod and the rotary rod, so that the left pull rod and the right pull rod are prevented from automatically rotating outwards, which may otherwise cause injuries to people. Thus, the reliability, comfort and safety of the exercise machine in use are effectively improved.

DETAILED DESCRIPTION OF THE INVENTION

The invention is further described in combination with the drawings and specific embodiments as follows.

Figure 1:
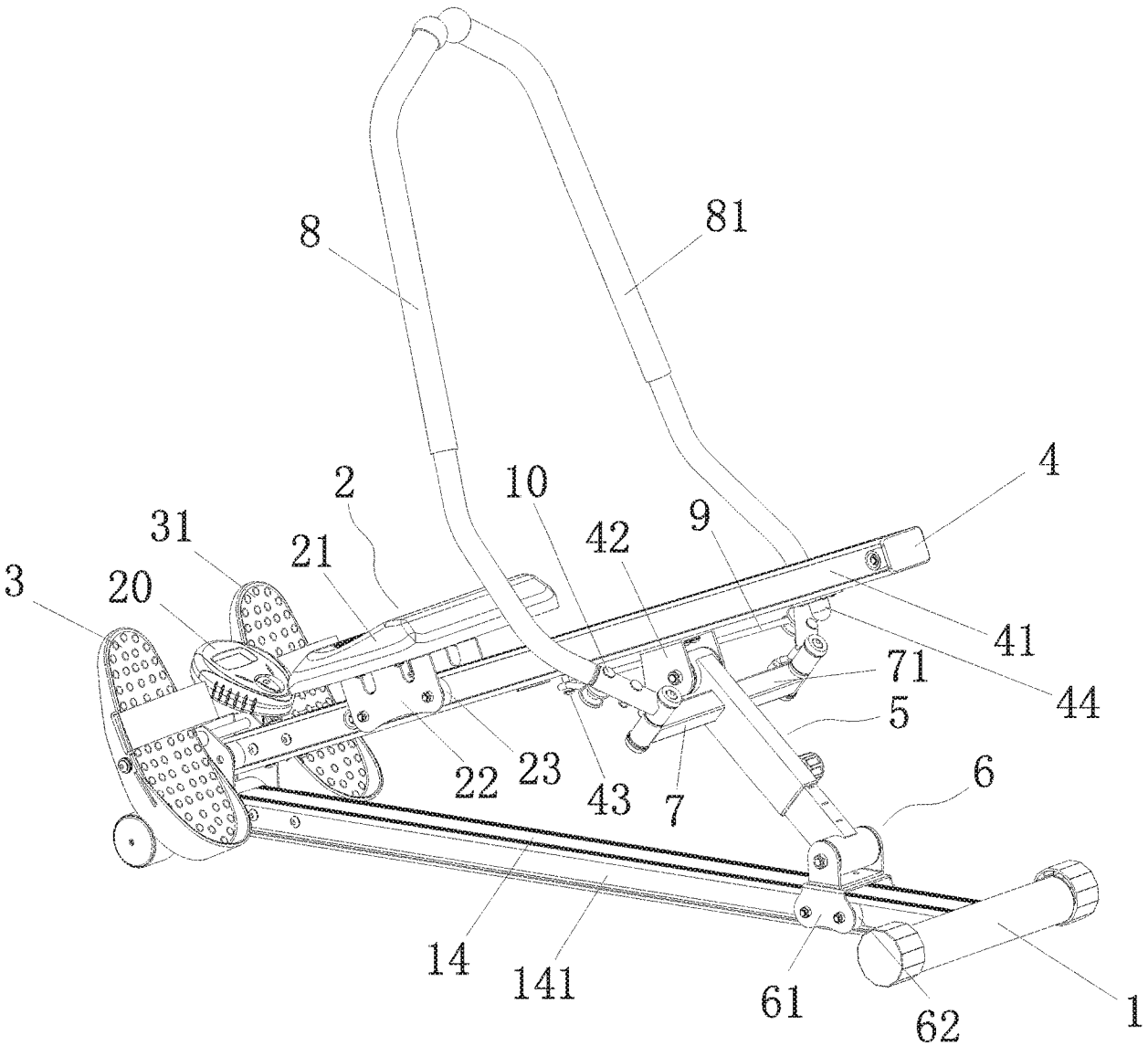
FIG. 1 is a perspective view of the invention.
Figure 2:
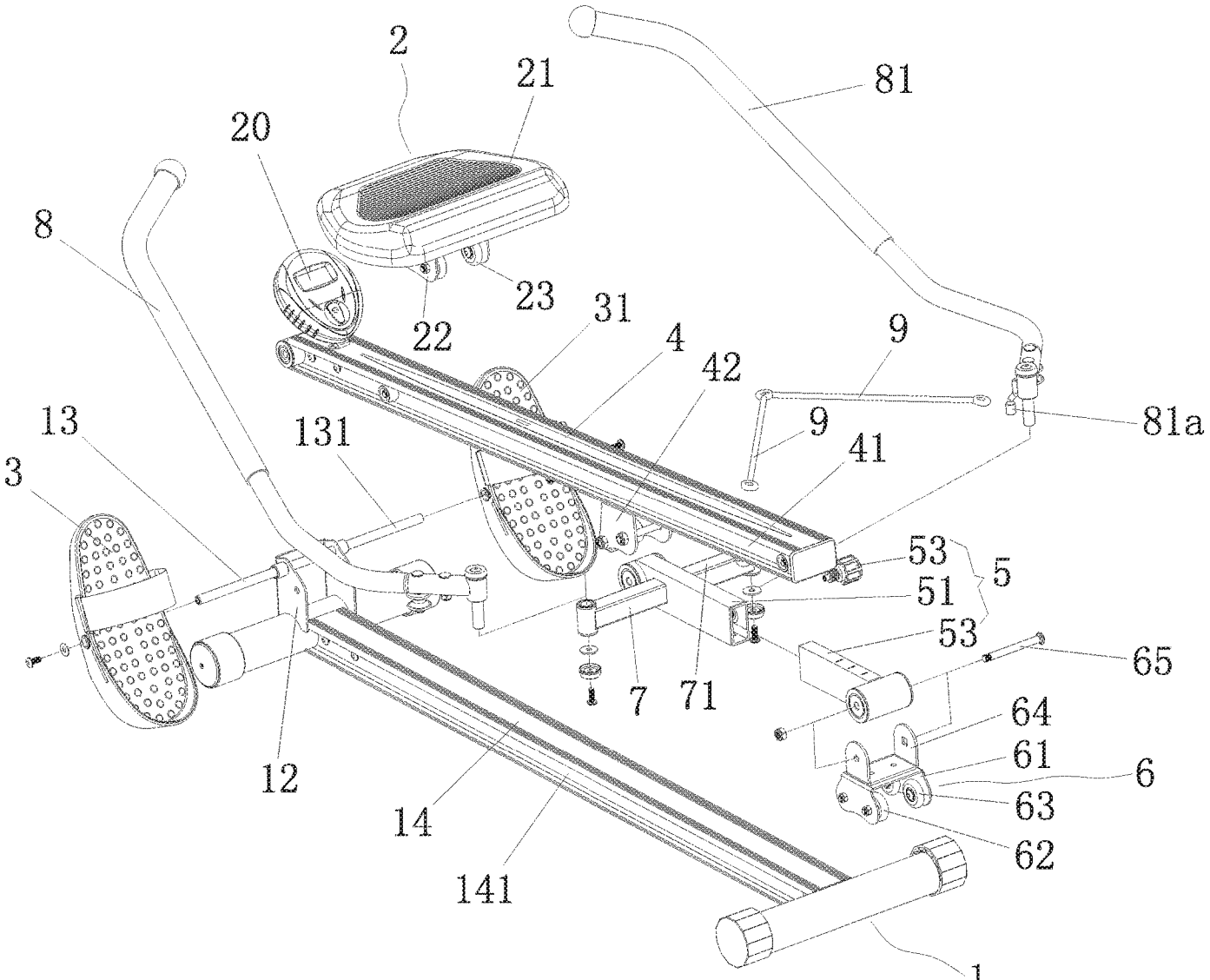
FIG. 2 is an exploded perspective view of the invention.
Figure 3:
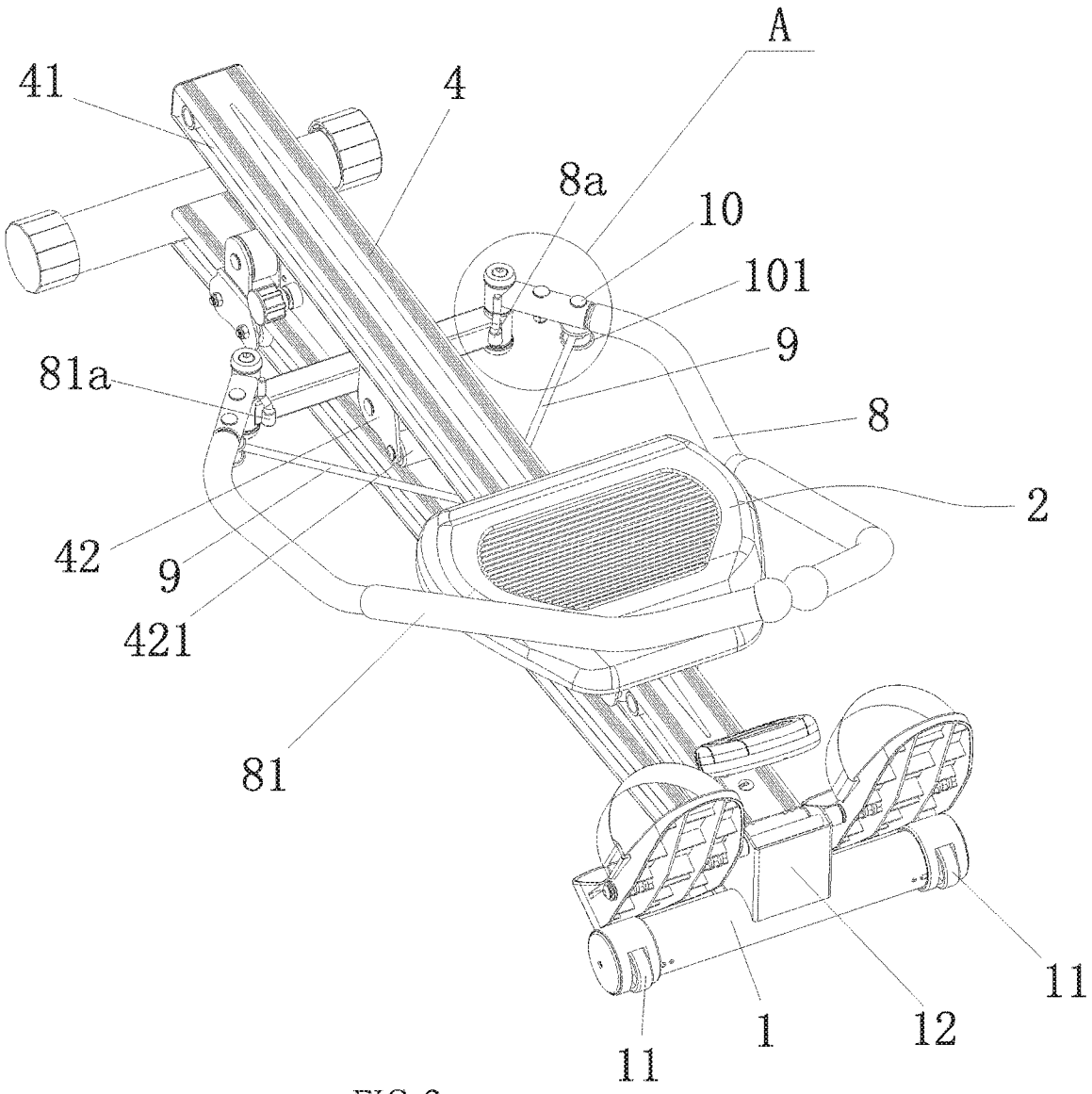
FIG. 3 is a front perspective view of the invention when a rotary rod is lowered to the lowest position.
Figure 4:
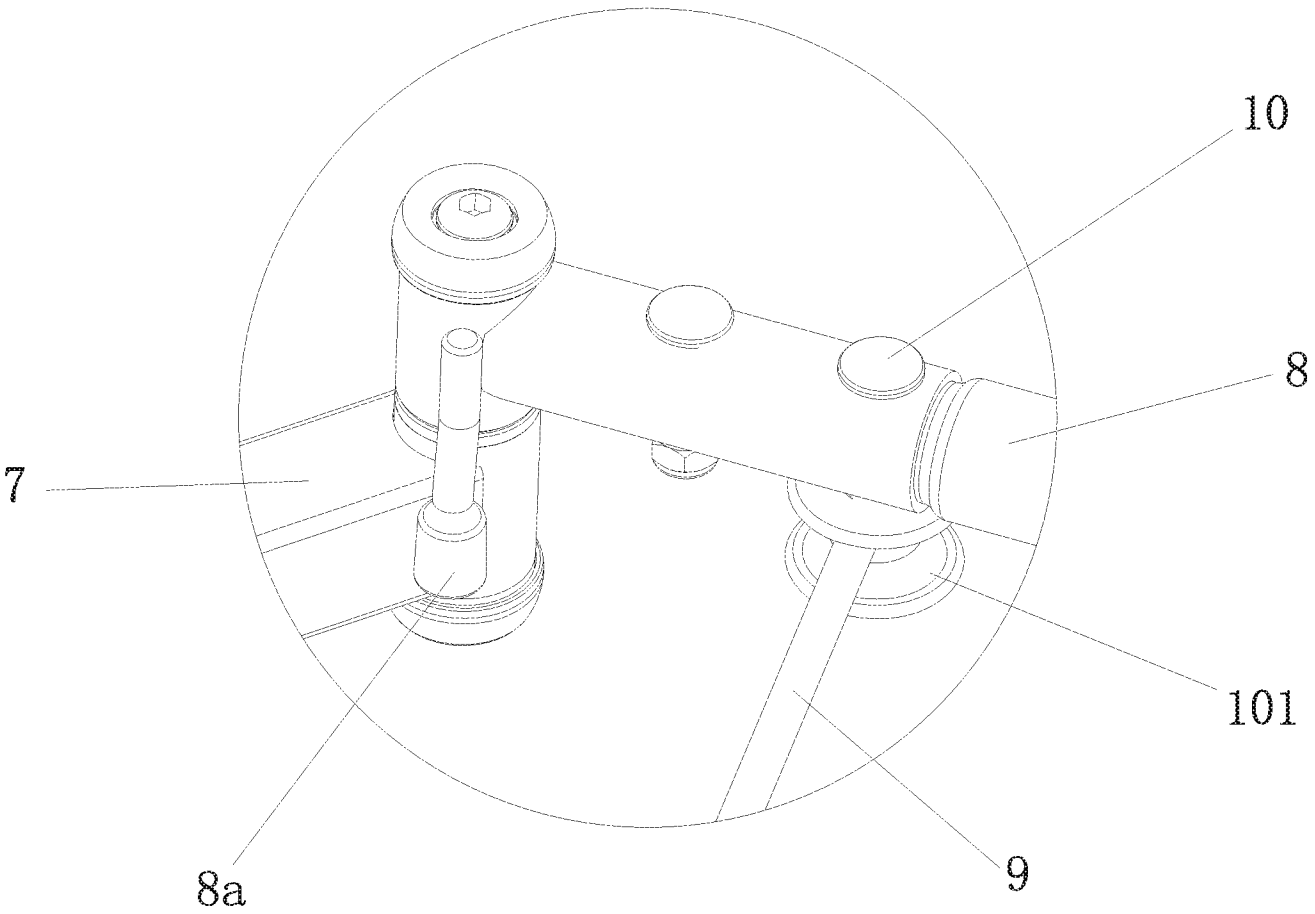
FIG. 4 is an enlarged view of part A in FIG. 3.
Figure 5:
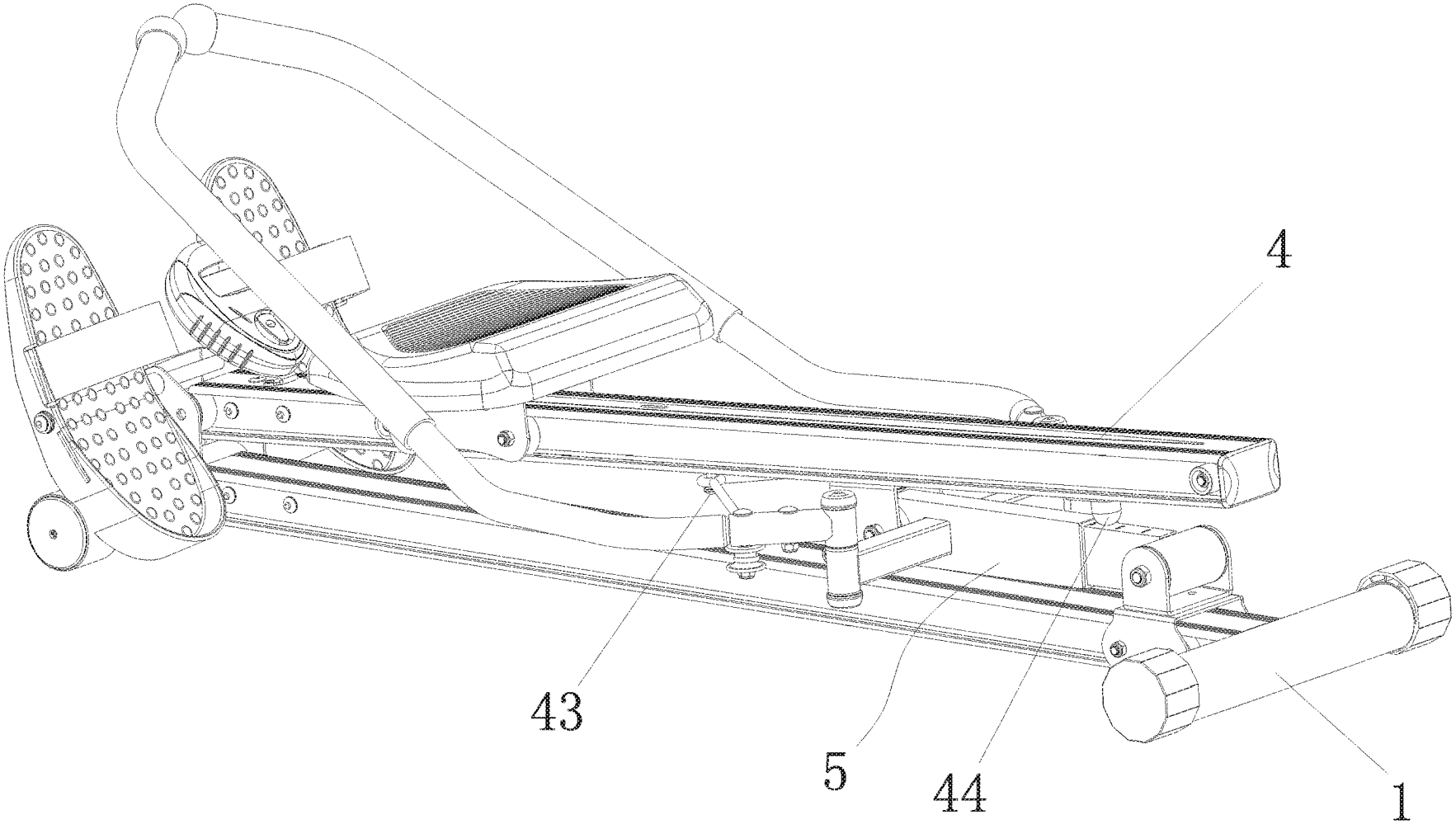
FIG. 5 is a rear perspective view of the invention when the rotary rod is lowered to the lowest position.

As shown in FIGS. 1-5, an exercise machine with boating and riding exercise effects includes a base 1, a cushion 2, a left pedal 3, a right pedal 31, a rotary rod 4 and a supporting rod 5. The base 1 is approximately in an H shape. Two rolling wheels 11 are disposed on the lower portion of the front end of the base 1 so that the whole exercise machine can be dragged to be stored. A protruding frame 12 extends upwards from the middle of the front end of the base 1. A left horizontal dowel pin 13 is arranged on the left side of the protruding frame 12. The left pedal 3 is rotatably disposed around the left horizontal dowel pin 13. A right horizontal dowel pin 131 is arranged on the right side of the protruding frame 12. The right pedal 31 is rotatably disposed around the right horizontal dowel pin 131.

The front end of the rotary rod 4 is hinged to the protruding frame 12 at the front end of the base 1. The cushion 2 is slidably connected to the rotary rod 4. Particularly, the cushion 2 includes a cushion plate 21 and a second n-shaped frame 22 fixedly connected to the lower side of the cushion plate 21. Two cushion wheels 23 are disposed on each of two inner side faces of the second n-shaped frame 22. A cushion guide groove 41 is formed in each of two side faces of the rotary rod 4. Each cushion guide groove 41 is matched with the two corresponding cushion wheels 23. A front limiting stopper and a rear limiting stopper are arranged on each cushion guide groove 41 and used to limit the sliding distance of the cushion 2.

A supporting rail 14 is arranged on the base 1. Guide grooves 141 are respectively formed in two sides of the supporting rail 14. A sliding frame 6 is cooperatively disposed on the supporting rail 14 and includes a first n-shaped frame 61. Two left wheels 62 are disposed on the left inner side of the first n-shaped frame. Two right wheels 63 are disposed on the right inner side of the first n-shaped frame 61. The two left wheels 62 and the two right wheels 63 are respectively matched with the guide grooves 141 in the two sides of the supporting rail 14.

A third n-shaped frame 42 is fixedly arranged on the middle lower portion of the rotary rod 4 and hinged to one end of the supporting rod 5. A first limiting post 421 is disposed on the third n-shaped frame 42 and used to limit the clockwise rotation angle of the supporting rod 5.

Two protrusions 64 respectively extend out from two sides of the upper portion of the first n-shaped frame 61 and are hinged to the other end of the supporting rod 5 through a hinge pin 65.

A left cross rod 7 and a right cross rod 71 respectively extend out from two sides of the middle of supporting rod 5. A left pull rod 8 and a right pull rod 81 are respectively hinged to the end of the left cross rod 7 and the end of the right cross rod 71. Elastic ropes 9 are respectively disposed between the left pull rod 8 and the rotary rod 4 as well as between the right pull rod 81 and the rotary rod 4.

A first suspension pin 43 is arranged on the lower portion of the rotary rod 4. Second suspension pins 10 are respectively arranged in the middle of the left pull rod 8 and the middle of the right pull rod 81. The elastic ropes 9 are suspended between the second suspension pins 10 and the first suspension pin 43. Hooking wheels 101 are disposed on the second suspension pins 10. One ends of the elastic ropes 9 are wound on the hooking wheels 101, and the other ends of the two elastic ropes 9 are connected together and hooked on the first suspension pin 43.

A left limiting part **8*a* is fixedly arranged on the outer surface of an end, close to the left cross rod 7, of the left pull rod 8. When touching the left cross rod 7, the left limiting part 8*a* restrains the left pull rod 8 from continuing to rotate towards the rotary rod 4. A right limiting part 81*a* is fixedly arranged on the outer surface of an end, close to the right cross rod 71, of the right pull rod 81. When touching the right cross rod 71, the right limiting part 81*a* restrains the right pull rod 81 from continuing to rotate towards the rotary rod 4. In this way, the left pull rod 8 and the right pull rod 81** will not deflect towards one side during exercise.

A second limiting post 44 is arranged on the rear lower portion of the rotary rod 4 and matched with the supporting rod 5 to limit the descent height of the free end of the rotary rod 4. A counter 20 is arranged on the upper side of the front end of the rotary rod 4.

The supporting rod 5 includes a front supporting rod section 51 and a rear supporting rod section 52. The front supporting rod section 51 is sleeved with the rear supporting rod section 52, which is provided with a plurality of positioning holes at intervals. An adjusting bolt 53 penetrates through the side face of the front supporting rod section 51 to be selectively matched with one positioning hole on the rear supporting rod section 52. In this way, the length of the supporting rod 5 can be changed, and the pulling force to the left pull rod 8 and the right pull rod 81 can also be changed.

When the exercise machine in this embodiment is used, the user sits on the cushion 2 to make boating motions by stepping on the left pedal 3 and the right pedal 31 with both feet and by holding the left pull rod 8 and the right pull rod 81 with both hands. Under the combined effect of a pulling force and the weight of the user, the supporting rod 5 and the rotary rod 4 rotate back and forth, so that the human body also moves upwards, downwards, forwards and backwards while making boating motions, and thus, both a boating exercise effect and a riding exercise effect are achieved.

The above embodiment is only a preferred embodiment of the invention. All equivalent transformations made by those skilled in this field based on the Claims should fall within the protection scope of the invention.

What is claimed is:

1. An exercise machine with boating and riding exercise effects, the exercise machine comprising: a base and a cushion, wherein a front end of a rotary rod is hinged to a front end of the base, the cushion is slidably connected to the rotary rod, and a left pedal and a right pedal are arranged at the front end of the base or at positions, close to the front end of the base, and of the rotary rod; a supporting rail is arranged on the base and has two sides respectively provided with guide grooves, a sliding frame is cooperatively disposed on the supporting rail and provided with left wheels and right wheels, and the left wheels and the right wheels are respectively matched with the guide grooves in the two sides of the supporting rail; and a supporting rod has an end hinged to a lower side of a middle of the rotary rod and an end hinged to the sliding frame, a left cross rod and a right cross rod respectively extend out from two sides of a middle of the supporting rod, and a left pull rod and a right pull rod are respectively hinged to an end of the left cross rod and an end of the right cross rod.

2. The exercise machine with boating and riding exercise effects according to claim 1, wherein elastic ropes are disposed between the left pull rod and the rotary rod as well as between the right pull rod and the rotary rod respectively.

3. The exercise machine with boating and riding exercise effects according to claim 2, wherein a first suspension pin is arranged on a lower portion of the rotary rod, second suspension pins are respectively arranged in a middle of the left pull rod and a middle of the right pull rod, and the elastic ropes are suspended between the second suspension pins and the first suspension pin; and hooking wheels are disposed on the second suspension pins, and one ends of the elastic ropes are wound on the hooking wheels.

4. The exercise machine with boating and riding exercise effects according to claim 1, wherein a left limiting part is fixedly arranged on an outer surface of an end, close to the left cross rod, of the left pull rod, and when touching the left cross rod, the left limiting part restrains the left pull rod from continuing to rotate towards the rotary rod; and a right limiting part is fixedly arranged on an outer surface of an end, close to the right cross rod, of the right pull rod, and when touching the right cross rod, the right limiting part restrains the right pull rod from continuing to rotate towards the rotary rod.

5. The exercise machine with boating and riding exercise effects according to claim 1, wherein the sliding frame includes a first n-shaped frame, two left wheels are arranged on a left inner side of the first n-shaped frame, two right wheels are arranged on a right inner side of the first n-shaped frame, the two left wheels and the two right wheels are respectively matched with the guide grooves in the two sides of the supporting rail, and two protrusions respectively extend out from two sides of an upper portion of the first n-shaped frame and hinged to an end of the supporting rod through a hinge pin.

6. The exercise machine with boating and riding exercise effects according to claim 1, wherein the cushion includes a cushion plate and an n-shaped frame fixedly connected to a lower side of the cushion plate, two cushion wheels are disposed on each of two inner side faces of the second n-shaped frame, a cushion guide groove is formed in each of two side faces of the rotary rod, and each said cushion groove is matched with the two corresponding cushion wheels.

7. The exercise machine with boating and riding exercise effects according to claim 1, wherein an n-shaped frame is fixedly arranged on a middle lower portion of the rotary rod and hinged to one end of the supporting rod, and a first limiting post is disposed on the third n-shaped frame and used to limit a clockwise rotation angle of the supporting rod.

8. The exercise machine with boating and riding exercise effects according to claim 1, wherein a limiting post is arranged on a rear lower portion of the rotary rod and matched with the supporting rod to limit a descent height of a free end of the rotary rod.

9. The exercise machine with boating and riding exercise effects according to claim 1, wherein a protruding frame extends upwards from a middle of the front end of the base, a left horizontal dowel pin is arranged on a left side of the protruding frame, the left pedal is rotatably disposed around the left horizontal dowel pin, a right horizontal dowel pin is arranged on a right side of the protruding frame, and the right pedal is rotatably disposed around the right horizontal dowel pin; and the rotary rod has an end hinged to the protruding frame, and a counter is arranged on an upper side of a front end of the rotary rod.

10. The exercise machine with boating and riding exercise effects according to any one of claim 1, wherein the supporting rod includes a front supporting rod section and a rear supporting rod section, the front supporting rod section is sleeved with the rear supporting rod section, which is provided with a plurality of positioning holes at intervals, and an adjusting bolt penetrates through a side face of the front supporting rod section to be selectively matched with one said positioning hole on the rear supporting rod section.

* * * * *